US006939243B1

(12) United States Patent
Mitchell et al.

(10) Patent No.: US 6,939,243 B1
(45) Date of Patent: Sep. 6, 2005

(54) GOLF PUTTING AND CHIPPING TRAINING DEVICES

(75) Inventors: Lawson C. Mitchell, Ormond Beach, FL (US); Kenneth Robinson, Daytona Beach, FL (US)

(73) Assignee: The Perfect Link, Inc., Ormond Beach, FL (US)

( * ) Notice: Subject to any disclaimer, the term of this patent is extended or adjusted under 35 U.S.C. 154(b) by 0 days.

(21) Appl. No.: 10/735,227

(22) Filed: Dec. 12, 2003

Related U.S. Application Data

(63) Continuation-in-part of application No. 10/208,472, filed on Jul. 29, 2002, which is a continuation of application No. 09/735,015, filed on Dec. 12, 2000, now abandoned.

(51) Int. Cl.[7] ..... A63B 69/36
(52) U.S. Cl. ..... 473/227
(58) Field of Search ..... 473/212–213, 473/223, 226–227, 239, 248, 276–277, 282

(56) References Cited

U.S. PATENT DOCUMENTS 3,951,416 A * 4/1976 Koch et al. ..... 473/212
5,320,354 A * 6/1994 Vasquez ..... 473/213
5,465,971 A * 11/1995 Tischler ..... 473/227
5,470,073 A * 11/1995 Vasquez ..... 473/206
5,772,523 A * 6/1998 Sheftic ..... 473/227
5,865,685 A * 2/1999 Thomas ..... 473/213
5,904,624 A * 5/1999 Martinez ..... 473/212
5,976,024 A * 11/1999 Marshall, Jr. ..... 473/227
6,004,221 A * 12/1999 Thornhill ..... 473/227
6,110,054 A * 8/2000 Rodarte ..... 473/203
6,398,663 B1 * 6/2002 Lin ..... 473/220
6,533,676 B1 * 3/2003 D'Angelo et al. ..... 473/239
6,656,056 B1 * 12/2003 Leonard ..... 473/227

* cited by examiner

*Primary Examiner*—Raeann Gorden
(74) *Attorney, Agent, or Firm*—Brian S. Steinberger; Law Offices of Brian S. Steinberger, P.A.

(57) ABSTRACT

Golf training devices and methods of using a training device, that includes primarily for putting and chipping. The invention can include an attachment socket for attaching the device on top of a hand grip of a golf club and a plate extending from the top of the attachment socket at a bent angle approximately 45 degrees in elevation and at a twisted angle or preferably approximately 15 degrees away from the body of the golfer so that it rests against the lower inner forward forearm of a golfer during putting and chipping. The plate is narrow on a proximal end and wider on a distal end where it is slightly concave to conform to the shape of the forearm. The device is removably attached to the golf club by a fastener on the attachment socket having a threaded hole with an adjustment screw tightening an inner clamp against the grip of the golf club so that the grip of the golf club is fastened in the attachment socket. Another version can have two upwardly extending plates that extend in opposite directions to each other from the hand grip. The versions can also be permanently affixed to the clubs.

14 Claims, 15 Drawing Sheets

A
A

X
Z
4

6
X
Y
1
15°

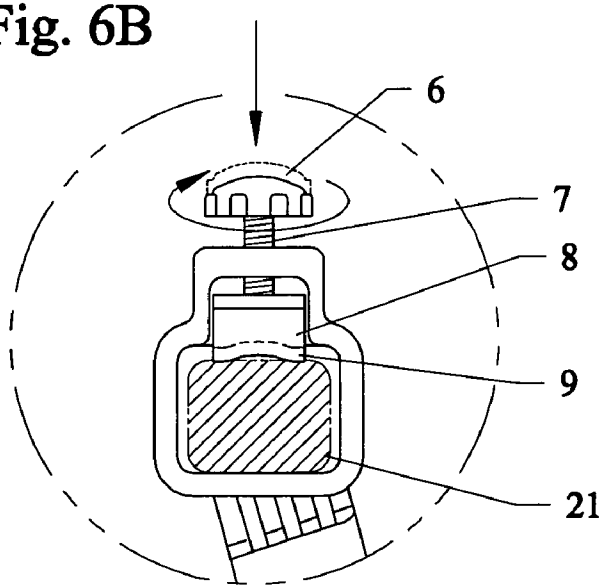
Fig. 6B
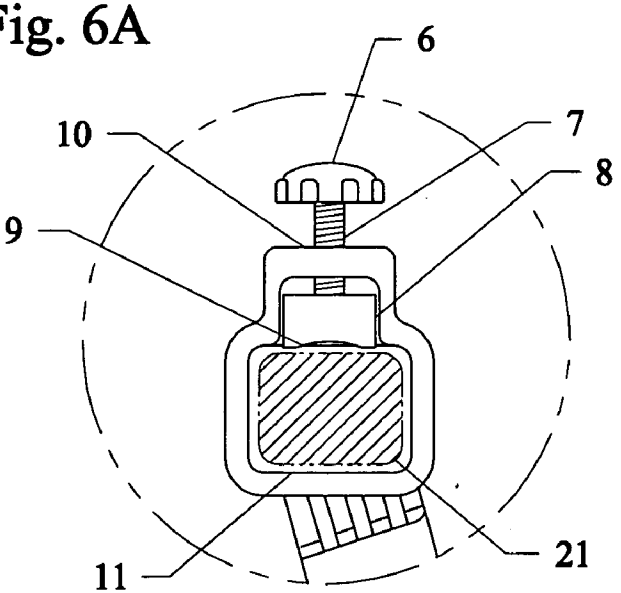
Fig. 6A
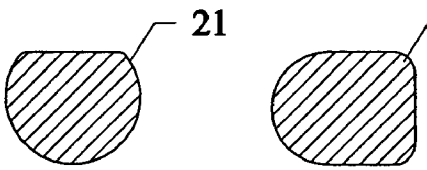
Fig. 7D
Fig. 7C
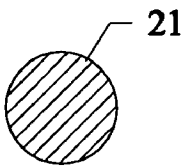
Fig. 7B
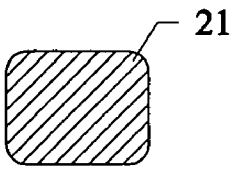
Fig. 7A Fig. 11
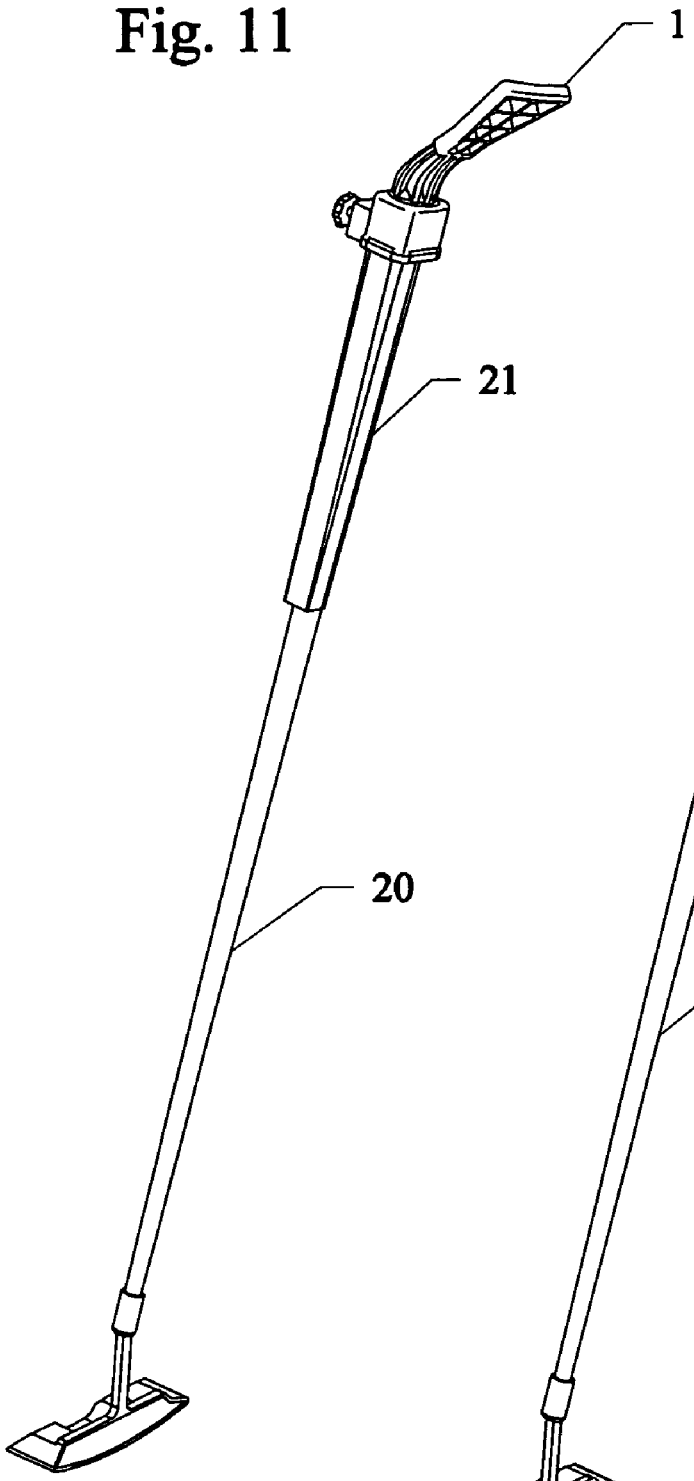
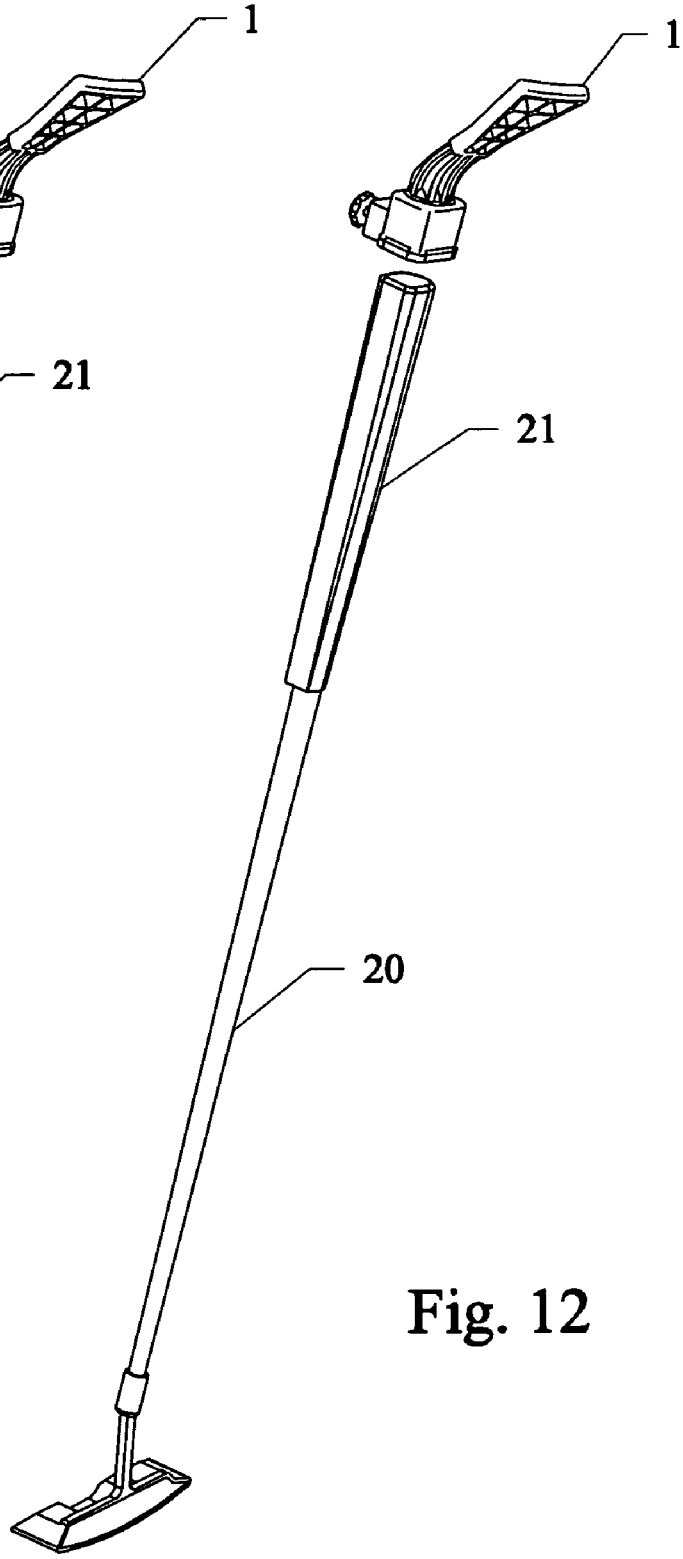
Fig. 12

Fig. 13A
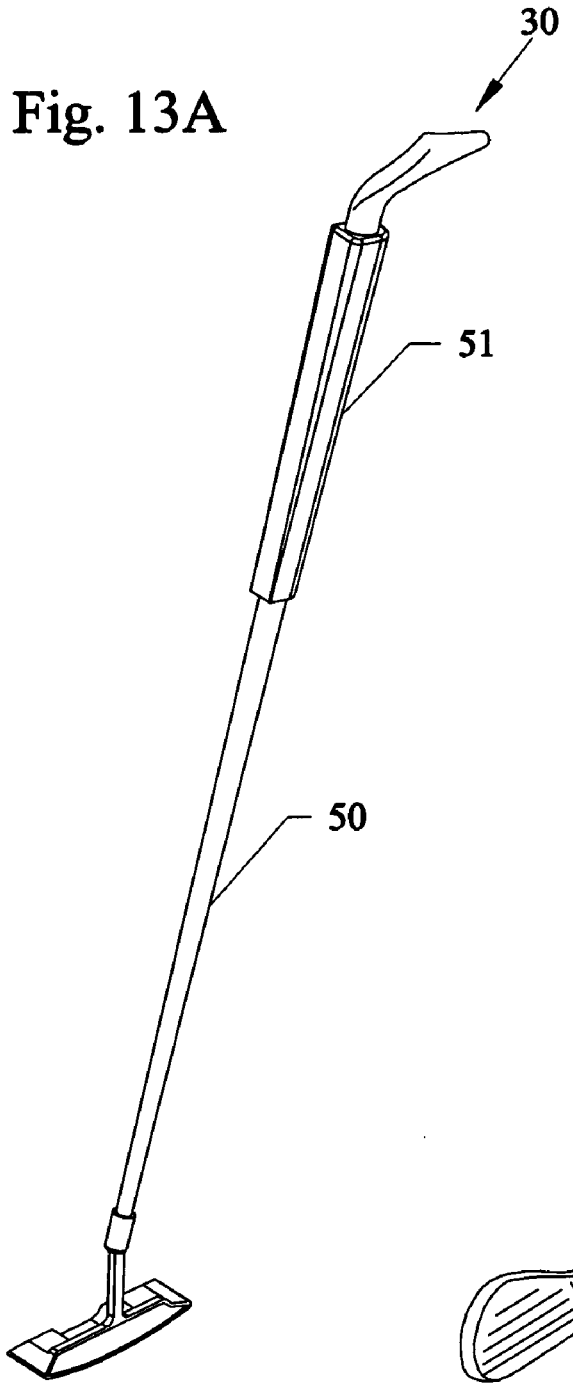
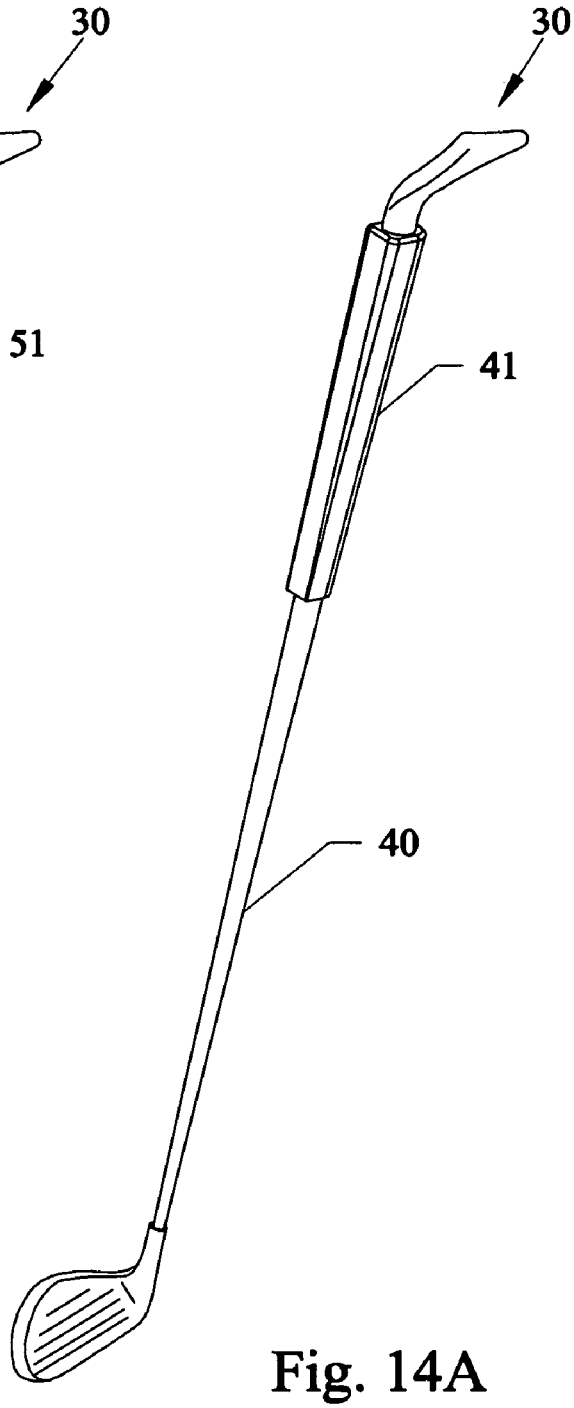
Fig. 14A

Fig. 16
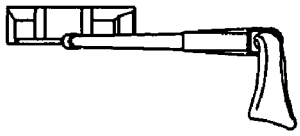
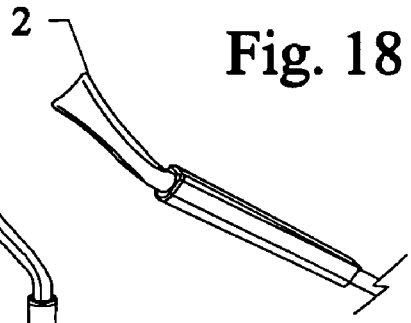
Fig. 18
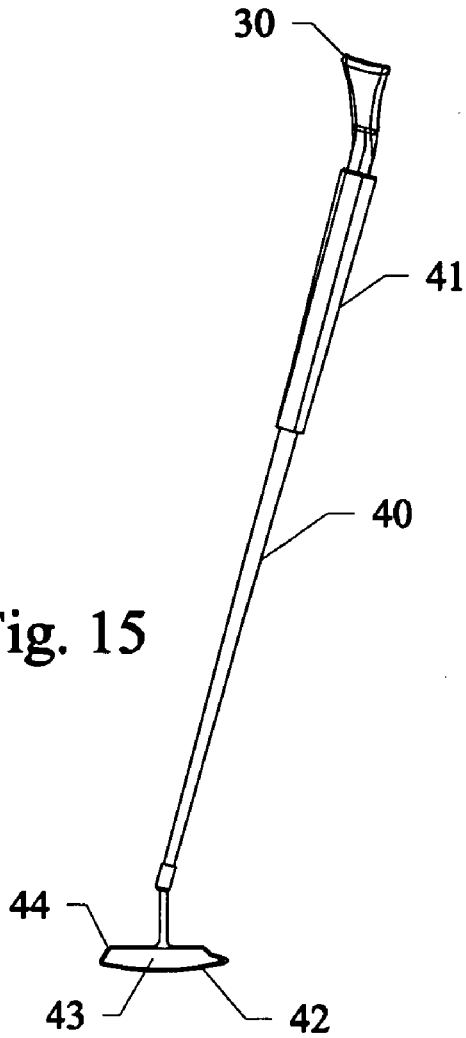
Fig. 15
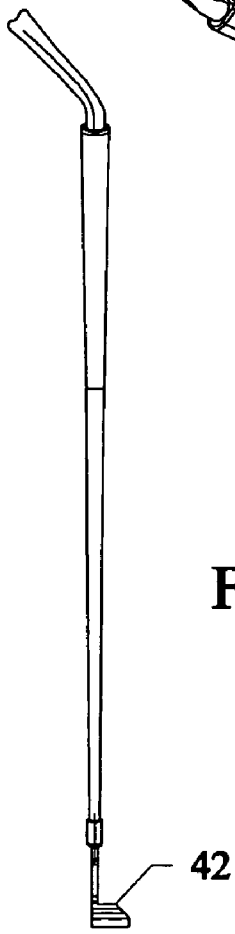
Fig. 17

GOLF PUTTING AND CHIPPING TRAINING DEVICES

This invention is a Continuation-In-Part of Ser. No. 10/208,472 filed Jul. 29, 2002, which is a continuation of application Ser. No. 09/735,015, filed Dec. 12, 2000, now abandoned.

FIELD OF THE INVENTION

This invention relates to golf clubs and more particularly to golf training devices and methods for teaching optimum and correct putting and chipping which can be integrated into golf clubs or used as a separate and removable attachment for attaching to the hand grip of golf clubs.

BACKGROUND OF THE INVENTION

Position and form are very important in golf for achieving an accurate stroke. When swinging a golf club, particularly during putting and chipping, the desired position is one in which the arms form an approximate triangular formation with respect to the golf club. Such a position enables the larger muscles of the upper arm, back and shoulders, not the muscles of the wrist and forearm, to be used throughout a putting or chipping stroke. Unfortunately, what commonly happens is that a golfer uses the smaller muscles of the wrist and forearm when putting and chipping which results in disaster caused by the forward wrist breaking down in the putt or chip.

Thus, a need exists for solutions such as devices to train golfers in the proper form and stroke, particularly for putting and chipping shots.

The inventors are aware of various patents directed toward training and educating golfers, but none like the present invention.

U.S. Pat. No. 5,772,523 to Sheftic describes a golf training device having a bent tubular configuration that requires an "end 30 shaped to contact the body of a golfer when the golfer fails to pivot or maintain a solid leading arm", column 3, lines 5–7. In essence the device is not intended to continuously contact the body of a golfer to maintain triangulation for putting and chipping shots.

U.S. Pat. Nos. 5,320,354 and 5,470,073 to Vasquez each describe various golf instructional devices that generally require multiple screw type fasteners that must be individually manipulated in order for the instructional device to work.

U.S. Pat. No. 5,374,064 to Barber discloses a golf club training device that requires a club modification and consists of an attachment which fits over a modified handle of a golf club. U.S. Pat. No. 6,110,054 to Rodarte discloses a new golf club grip that attaches to the top of a shaft of the club and is angled forward to rest against the rear arm of the golfer, rather than the forward arm as does the present invention. U.S. Pat. No. 5,248,146 to Viets, et al. discloses a putting trainer that attaches in the hole on top of a putter and has a crossbar with two U-channels at each end to engage both arms and hold them in a proper position during a swing.

U.S. Pat. No. 2,273,416 to Norwood discloses yet another golf swing training device that wraps around the shaft and has a strap which wraps around the rear wrist. U.S. Pat. No. 5,470,073 to Vasquez teaches another device that fits over the top of the shaft and has one or two wrist collars extending therefrom. U.S. Pat. No. 5,904,624 to Martinez discloses another arm holding device that attaches to the top of a golf club. U.S. Pat. No. 5,941,780 to Marier, Jr. discloses a putting practice device that is secured by a golf tee on the top of the shaft of the club and has a curved front to rest against the wrist of the front arm and holes to adjust the placement thereof. U.S. Pat. No. 5,524,892 to Karp discloses a golf club positioning and holding training device with a form-fitting grip that attaches to the standard grip of a golf club and uses an audible whistle to indicate a proper swing.

Although the prior art discloses many golf club training aids that are designed to hold the forearms during the swing, none is like the present invention which rests only against the front forearm to hold the arms in the proper triangular arrangement and anatomical position with respect to the shoulders and spine during putting and chipping.

SUMMARY OF THE INVENTION

A primary object of the present invention is to provide a golf teaching and training tool and method to teach proper form during a golf swing, primarily putting and chipping.

A secondary object of the present invention is to provide such a golf teaching and training device and method that does not require golf club modification.

A third object of the present invention is to provide such a golf teaching and training device and method that can be removably affixed to golf clubs as needed.

A fourth object of the present invention is to provide such a golf teaching and training device and method that can be used for both left and right hand players and cross-handed players.

A fifth object of the present invention is to provide such a golf teaching and training device and method that is easy and quick to use as compared to the prior art, and does not require plural pieces to assemble, and use.

A sixth object of the present invention is to provide such a golf teaching and training device and method that can fit on all clubs having standard round or pistal type grips, or any other grips.

The invention devices and methods fulfills the above and other objects by providing a golf training device that has a forearm plate which can be integral or separate and removably attached to a golf club. The forearm plate is preferably narrower at a proximal end from the golf club and is wider at a distal end, which is slightly concave at a point of contact with a lower inner forward arm of a golfer. The plate is attached to the top of the handle of a golf club by fastening portion. The fastening portion can include an attachment socket having a threaded hole and adjustment screw to secure a clamp plate tightly against the hand grip of the golf club. The plate can be both bent and twisted at angles to the golf club handle. The bent angle between the golf club and the arm plate is preferably approximately 45 degrees so as to achieve the proper triangular formation of the arms from the position on the hand grip to the golfer's shoulder. The twisted angle can be approximately 15 degrees.

The invention can be formed into a single piece of metal with the adjustment screw being separate. Alternatively, the invention can be molded into a single piece of plastic, with only one separate adjustment screw added on.

Another version of the invention can have the training device permanently affixed to the handle, so that the training device can be sold and always used with the club.

A still another version can have a training device with two upwardly extending (double) plates extending upward in opposite directions for allowing both the forward and the trailing forearm to be maintained in the correct triangular position with the shoulders throughout the swing. Thus, the shoulder and back muscles are used to optimize the stroke. The hands and the wrist stay passive and do not bend and twist.

The double plate version can also be formed into a single piece of metal with a separate adjustment screw. Alternatively, the invention can be molded into a single piece of plastic, with only one adjustment screw needed for use.

A still another version has the upwardly extending double plates permanently affixed to the handgrip of the golf club.

Further objects and advantages of this invention will be apparent from the following detailed description of the presently preferred embodiments which are illustrated schematically in the accompanying drawings.

BRIEF DESCRIPTION OF THE DRAWINGS

FIG. 6*a* is a close-up view of the bottom of the golf training device showing a cross section of a golf club grip as inserted in the attachment socket of the golf training device.

FIG. 6*b* is a close-up view of the bottom of the golf training device showing a cross section of a golf club grip as inserted in the attachment socket of the golf training device with the clamp plate positioned against the golf club grip by way of the adjustment screw and the adjustment screw knob.

FIGS. 7A to 7D are cross sectional views of the various shapes of golf club grips that can be accommodated by the golf training device.

FIG. 11 is a perspective view of the golf training device mounted to the grip of a golf club putter.

FIG. 12 is a perspective view of the golf training device detached from the grip of the golf club putter.

FIG. 13A is a perspective view of the second embodiment of the subject invention as an integral part of the golf club grip of a golf club putter for a right-handed golfer.

FIG. 14A is a perspective view of the second embodiment of the subject invention as an integral part of the golf club grip of a golf club iron for a right-handed golfer.

FIG. 15 is front view of the golf club putter of FIG. 13A as viewed with the face of the clubhead of the golf club putter perpendicular to the view of the observer.

FIG. 16 is a top view of the golf club putter of FIG. 15.

FIG. 17 is side view of the golf club putter of FIG. 15 as viewed with the toe of the clubhead of the golf club putter directed to the view of the observer.

FIG. 18 is a partial view of the golf club putter of FIG. 15 with the golf club rotated so that the forearm plate is perpendicular to the view of an observer.

DETAILED DESCRIPTIONS OF THE PREFERRED EMBODIMENTS

Figure 1:
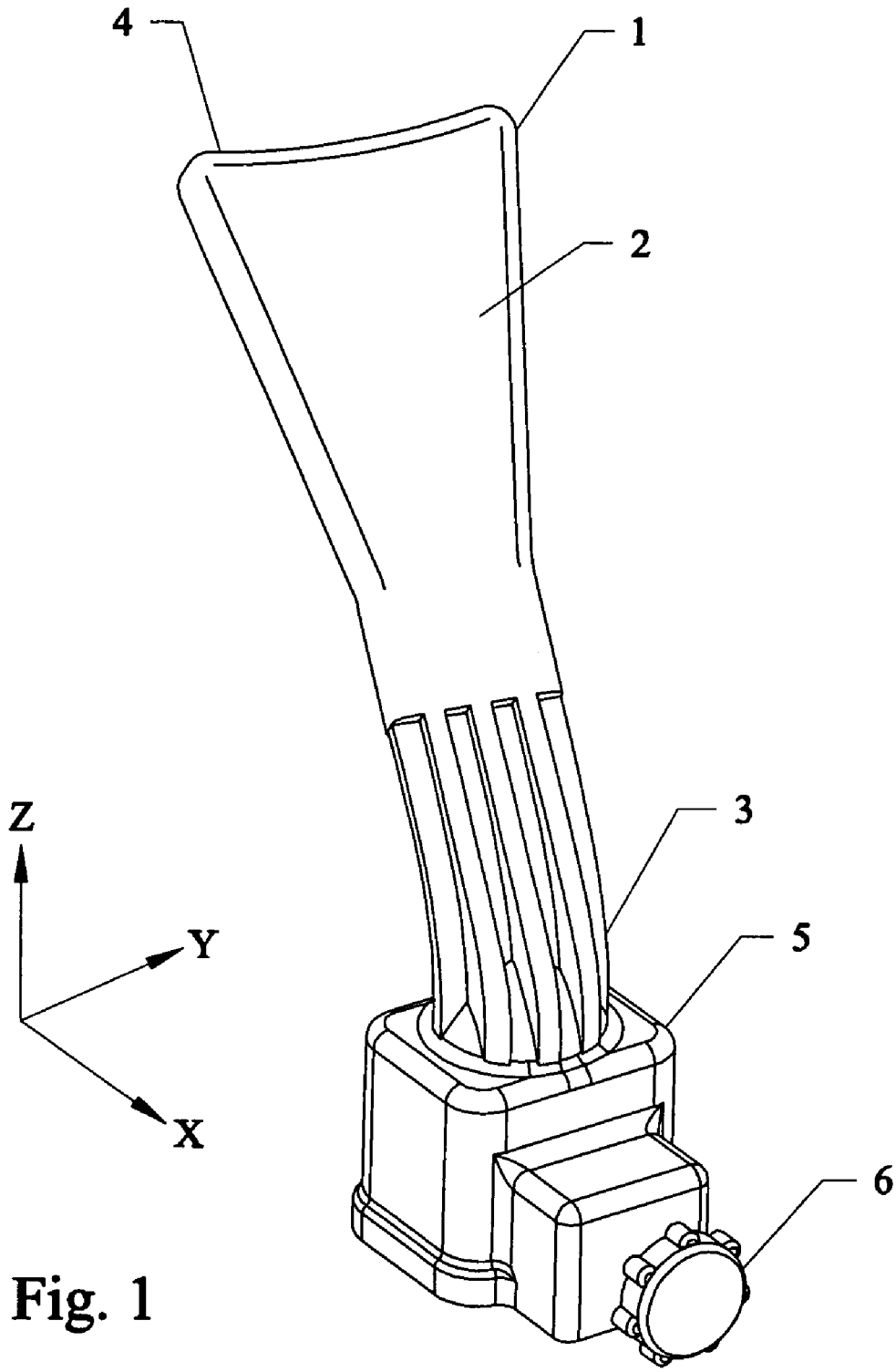
FIG. 1 is a front perspective view of a first preferred embodiment of the golf training device.

Before explaining the disclosed embodiments of the invention in detail it is to be understood that the invention is not limited in its application to the details of the particular arrangements shown since the invention is capable of other embodiments. Also, the terminology used herein is for the purpose of description and not of limitation.

Figures 2, 3, 4, 5, 6:
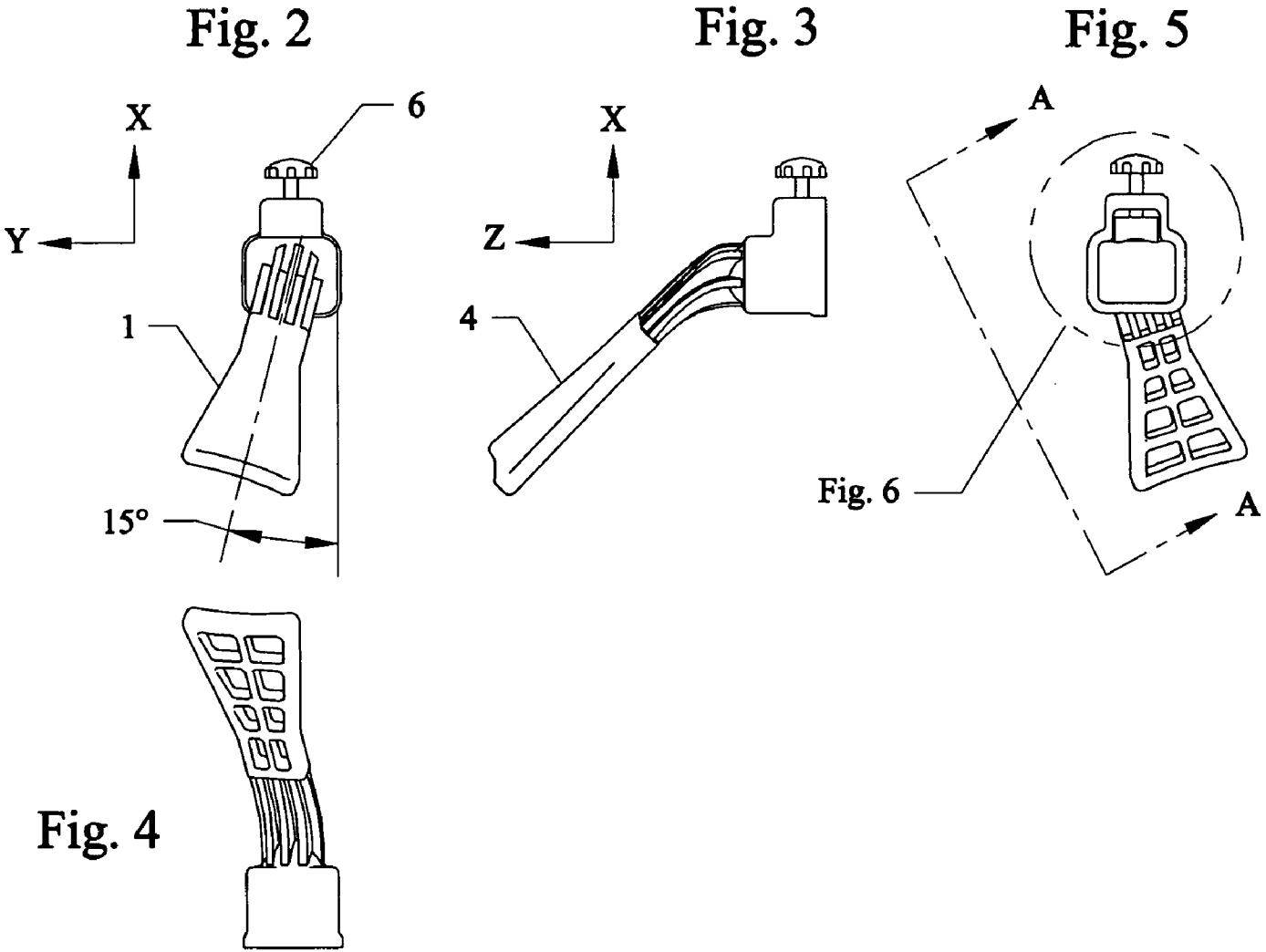
FIG. 2 is a top view of the golf training device of FIG. 1.
FIG. 3 is a side view of the golf training device of FIG. 2 rotated 90 degrees about the x-axis.
FIG. 4 is a rear view of the golf training device of FIG. 2 rotated 90 degrees about the y-axis.
FIG. 5 is a bottom view of the golf training device of FIG. 2 rotated 180 degrees about the x-axis.
Figure 10:
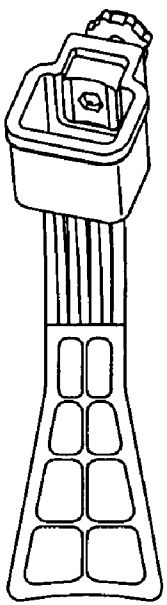
FIG. 10 is a rear perspective view of the golf training device of FIG. 8 rotated 180 degrees about the longitudinal axis of the forearm plate.
Figure 9A:
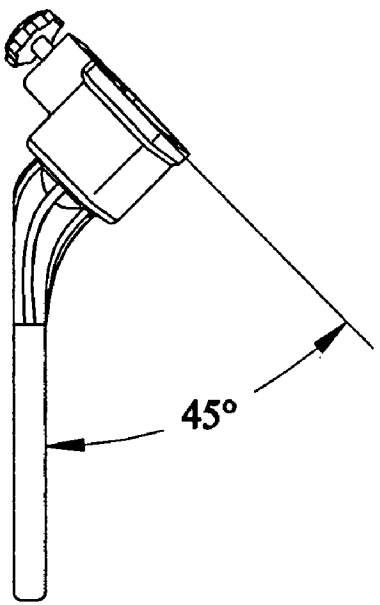
FIG. 9A is a side view of the golf training device of FIG. 8 rotated 90 degrees about the longitudinal axis of the forearm plate and as taken along line A—A of FIG. 5.
Figure 9B:
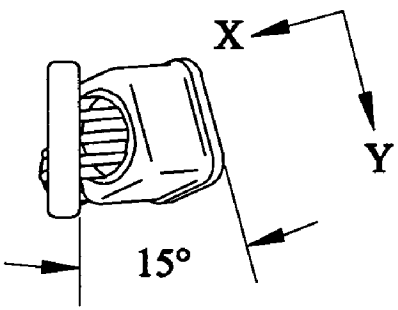
FIG. 9B is a view of the golf training device of FIG. 9A rotated 90 degrees about a line perpendicular to the longitudinal axis of the forearm plate and perpendicular to the surface of the forearm plate.
Figure 8:
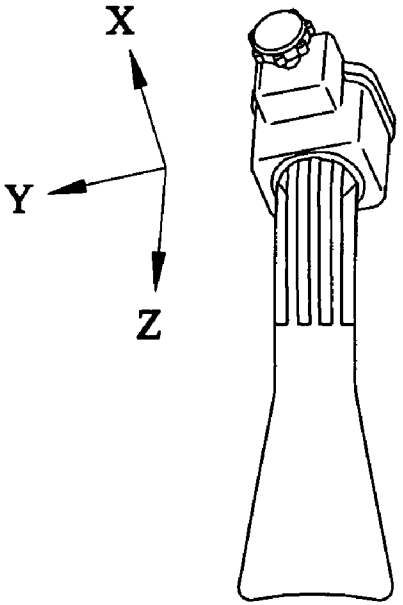
FIG. 8 is an inverted front perspective view of the golf training device of FIG. 1 with the forearm plate in a downward vertical position.

For purposes of describing the preferred embodiment, the terminology used in reference to the numbered components in the drawings is as follows:

1. training device
2. forearm plate
3. proximal end of forearm plate
4. distal end of forearm plate
5. attachment socket
6. adjustment screw knob
7. adjustment screw
8. clamp plate
9. bottom of clamp plate
10. threaded hole
20. golf club putter
21. golf club grip
30. second embodiment of golf training device
40. golf club putter
41. golf club grip
42. clubhead
43. face
44. toe
50. golf club iron
51. golf club grip
60. golfer
61. left arm
62. right arm
70. third embodiment of golf training device
71. left forearm plate
72. right forearm plate
80. fourth embodiment of golf training device
90. golf club putter
91. golf club grip FIG. 1 is a front perspective view of a first preferred embodiment of the golf training device 1. FIG. 2 is a top view of the golf training device 1 of FIG. 1. FIG. 3 is a side view of the golf training device 1 of FIG. 2 rotated 90 degrees about the x-axis. FIG. 4 is a rear view of the golf training device 1 of FIG. 2 rotated 90 degrees about the y-axis. FIG. 5 is a bottom view of the golf training device 1 of FIG. 2 rotated 180 degrees about the x-axis. FIG. 6*a* is a close-up view of the bottom of the golf training device 1 showing a cross section of a golf club grip 21 as inserted in the attachment socket 5 of the golf training device 1. FIG. 6*b* is a close-up view of the bottom of the golf training device 1 showing a cross section of a golf club grip 21 as inserted in the attachment socket 5 of the golf training device 1 with the clamp plate 8 positioned against the golf club grip 21 by way of the adjustment screw 7 and the adjustment screw knob 6. FIGS. 7A to 7D are cross sectional views of the various shapes of golf club grips 9 that can be accommodated by the golf training device 1. FIG. 8 is an inverted front perspective view of the golf training device 1 of FIG. 1 with the forearm plate 2 in a downward vertical position. FIG. 9A is a side view of the golf training device 1 of FIG. 8 rotated 90 degrees about the longitudinal axis of the forearm plate 2 and as taken along line A—A of FIG. 5. FIG. 9B is a view of the golf training device 1 of FIG. 9A rotated 90 degrees about a line perpendicular to the longitudinal axis of the forearm plate 2 and perpendicular to surface of the forearm plate 2. FIG. 10 is a rear perspective view of the golf training device 1 of FIG. 8 rotated 180 degrees about the longitudinal axis of the forearm plate. FIG. 11 is a perspective view of the golf training device 1 mounted to the grip 21 of a golf club putter 20. FIG. 12 is a perspective view of the golf training device detached from the grip 21 of the golf club putter 20.

Referring to FIGS. 1–5, the golf training device 1 includes a forearm plate 2 that is shaped in a manner that is a wider, almost fan-shaped, distal end 4 that is slightly concave so that it wraps around the lower inner forward forearm of the golfer. The forearm plate 2 is narrower at its proximal end 3 where it is connected to a club attachment socket 5 that is releasably attached to the golf club. Referring to FIG. 2, the longitudinal axis of the forearm plate 2 is preferably twisted at an angle of up to approximately 15 degrees, preferably between approximately 5 degrees to approximately 15 degree angle to the x-axis of the golf training device 1. The plate 2 is preferably bent at approximately 30 to approximately 45 degrees, preferably approximately 45 degrees. Thus, the device can be both bent and twisted.

The most notable feature of the golf training device 1 shown in FIGS. 6A and 6B, not previously described in detail, is the attachment socket 5. The attachment socket 5 contains a threaded hole 10 for inserting an adjustment screw 7. Clamp plate 8 is rotatably affixed to adjustment screw 7 so that the clamp plate 8 is positioned toward the center of the attachment socket 5 as the adjustment screw 7 and adjustment screw knob 6 are rotated in a clockwise direction.

FIG. 6A shows a close-up bottom view of the golf training device 1 as it would appear before attachment to a grip 21, shown in cross-section, after the grip 21 has been inserted into attachment socket 5 of the golf training device 1. FIG. 6B shows a close-up bottom view of the golf training device 1 as it would appear attached to a grip 21, shown in cross-section, of the golf club 20. The bottom surface 9 of the clamp plate 8 contacts the side of the golf club grip 21. The golf training device 1 is secured to the grip 21 by turning the adjustment screw knob 6 on the adjustment screw 7 extending through the hole 10 in the attachment socket 5 so that it presses the clamp plate 8 against the side of the golf club 20 so the golf club grip 21 is secured firmly between the clamp plate 8 and the rear inner surface 11 of the attachment socket 5. Once the golf training device 1 is firmly attached, it can be used during play or practice. Once a golfer has completed his or her practice, the golf training device 1 can be easily removed by turning adjustment screw knob 6 in the opposite direction and removing it from the golf club 20.

FIGS. 7A to 7D show cross sectional views of the various shapes of golf club grips 21 that can be accommodated by the attachment socket 5 of golf training device 1.

Referring to FIGS. 8–10, the surface of the forearm plate 2 is bent at approximately a 45 degree angle to the bottom of the attachment socket 5 of the golf training device 1. FIG. 9B shows that the surface of the forearm plate 2 is slanted at approximately a 15 degree angle to the y-axis of the golf trainer device 1.

FIG. 11 shows the golf training device 1 attached to golf club grip 21 of golf club putter 20 for a right-handed golfer. FIG. 12 shows the golf training device 1 detached from the golf club grip 21 of golf club 20.

FIG. 13A is a perspective view of the second embodiment of the golf training device 30 fabricated as an integral part of the golf club grip 41 of the golf club putter 40 for use by a right-handed golfer. FIG. 14A is a perspective view of the second embodiment of the golf training device 30 fabricated as an integral part of the golf club grip 51 of the golf club iron 50 for use by a right-handed golfer.

Figures 13B, 14B:
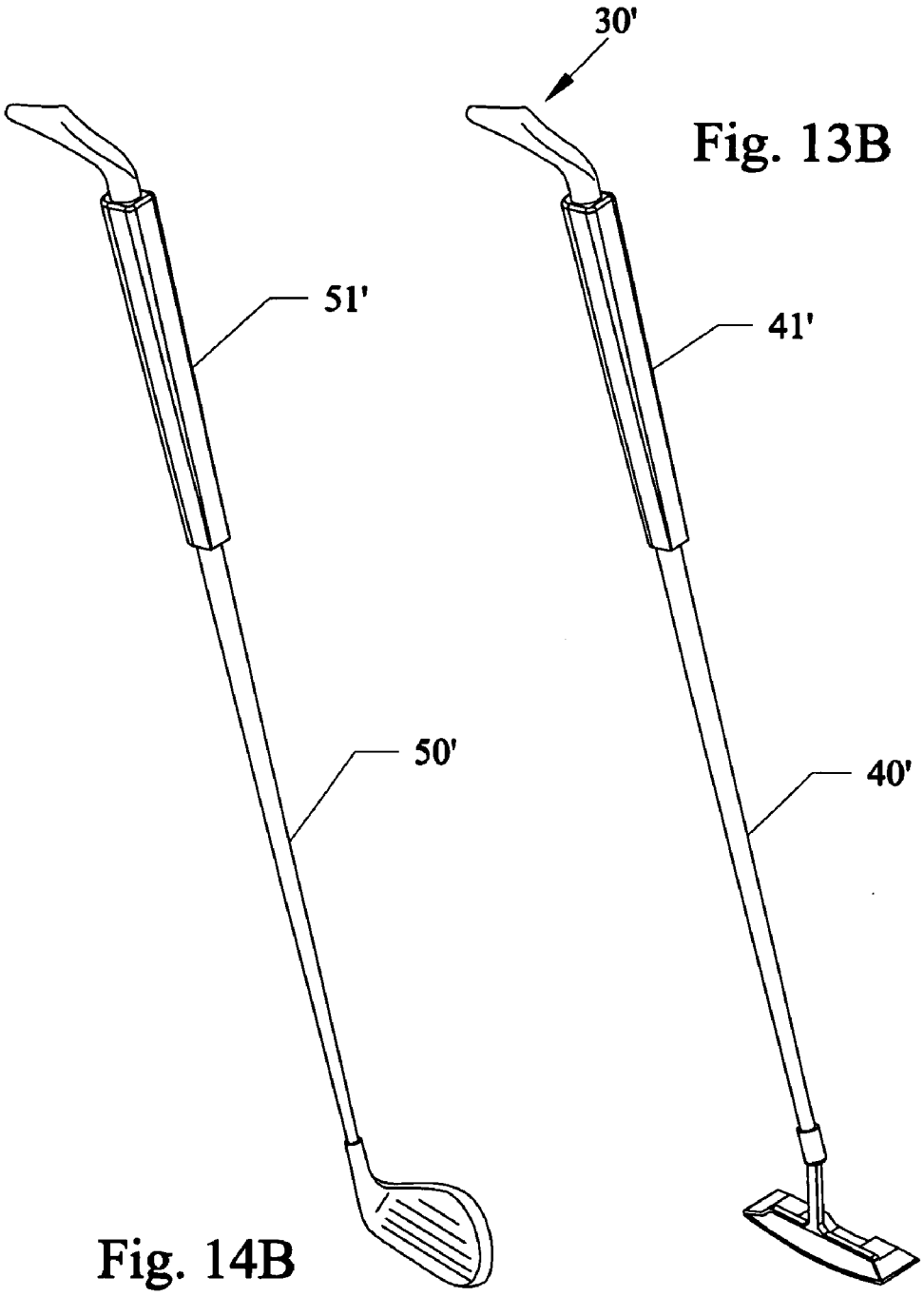
FIG. 13B is a perspective view of the second embodiment of the subject invention as an integral part of the golf club grip of a golf club putter for a left-handed golfer.
FIG. 14B is a perspective view of the second embodiment of the subject invention as an integral part of the golf club grip of a golf club iron for a left-handed golfer.

FIG. 13B is a perspective view of the second embodiment of the golf training device 30' fabricated as an integral part of the golf club grip 41' of the golf club putter 40' for use by a left-handed golfer. FIG. 14B is a perspective view of the second embodiment of the golf training device 30' fabricated as an integral part of the golf club grip 51' of the golf club 50' iron for use by a left-handed golfer.

FIG. 15 is front view of the golf club putter 40 of FIG. 13A as viewed with the face 43 of the clubhead 42 of the golf club putter 40 perpendicular to the view of the observer. FIG. 16 is a top view of the golf club putter 40 of FIG. 15. FIG. 17 is side view of the golf club putter 40 of FIG. 15 as viewed with the toe 44 of the clubhead 42 of the golf club putter 40 directed toward the view of the observer. FIG. 18 is a partial view of the golf club putter 40 of FIG. 15 with the golf club putter 40 rotated so that the forearm plate 2 is perpendicular to the view of an observer.

Figure 21:
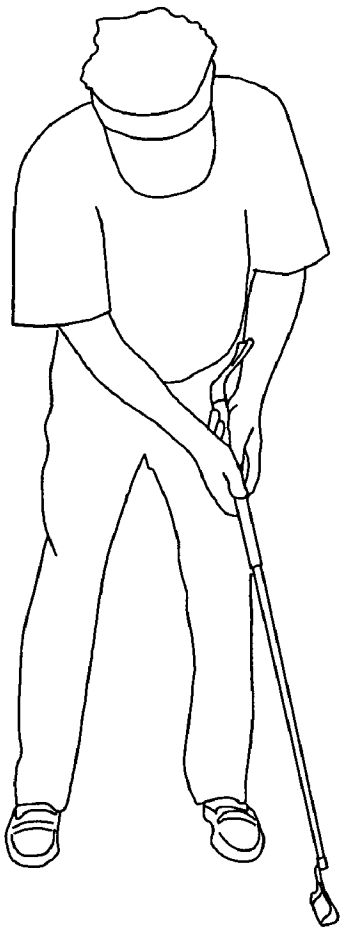
FIG. 21 is a perspective view of a right-handed golfer holding the golf club putter of FIG. 13A at the follow through of the golf stroke.
Figure 20:
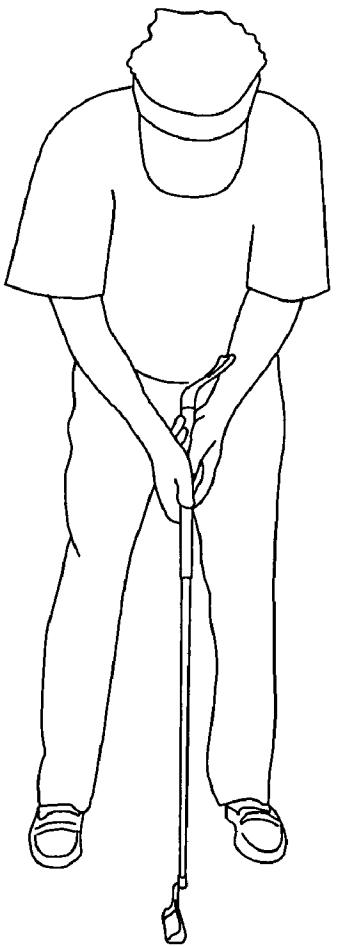
FIG. 20 is a perspective view of a right-handed golfer holding the golf club putter of FIG. 13A in the center of the golf stroke.
Figure 19:
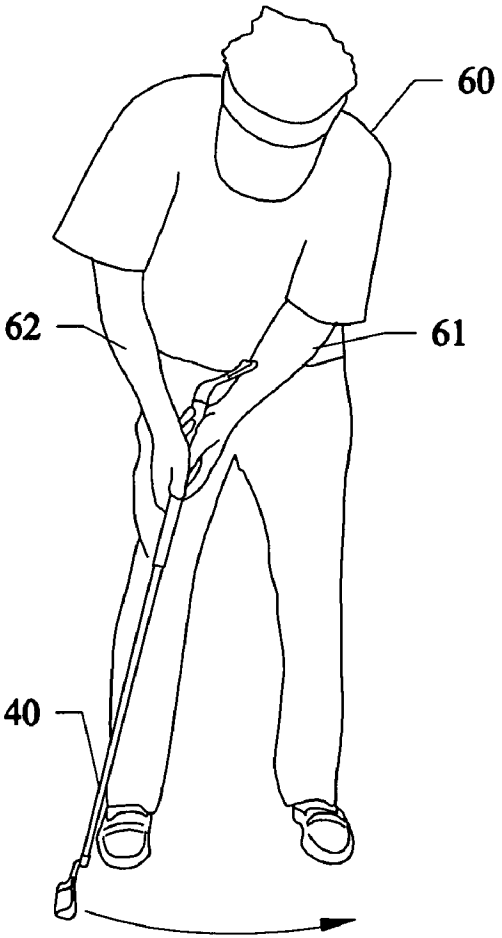
FIG. 19 is a perspective view of a right-handed golfer holding the golf club putter with the golf training device of FIG. 13A at the beginning of the golf stroke.

FIGS. 19–22 shows the training device 1 attached to the golf club putter 40 as it would appear when being used by the golfer 60. The use of the golf training device 1 of the present invention results in the arms 61 and 62 of the golfer being placed in a desired triangular formation so that it is the large muscles of the upper arms and shoulders which participate in the stroke, rather than the smaller muscles of the wrists and lower forearms. FIG. 19 is a perspective view of the right-handed golfer 60 holding the golf club putter 40 with the golf training device 30 of FIG. 13A at the beginning of the golf stroke. FIG. 20 is a perspective view of the right-handed golfer 60 holding the golf club putter 40 of FIG. 13A in the center of the golf stroke. FIG. 21 is a perspective view of the right-handed golfer 60 holding the golf club putter 40 of FIG. 13A at the follow-through of the golf stroke.

Figure 22:
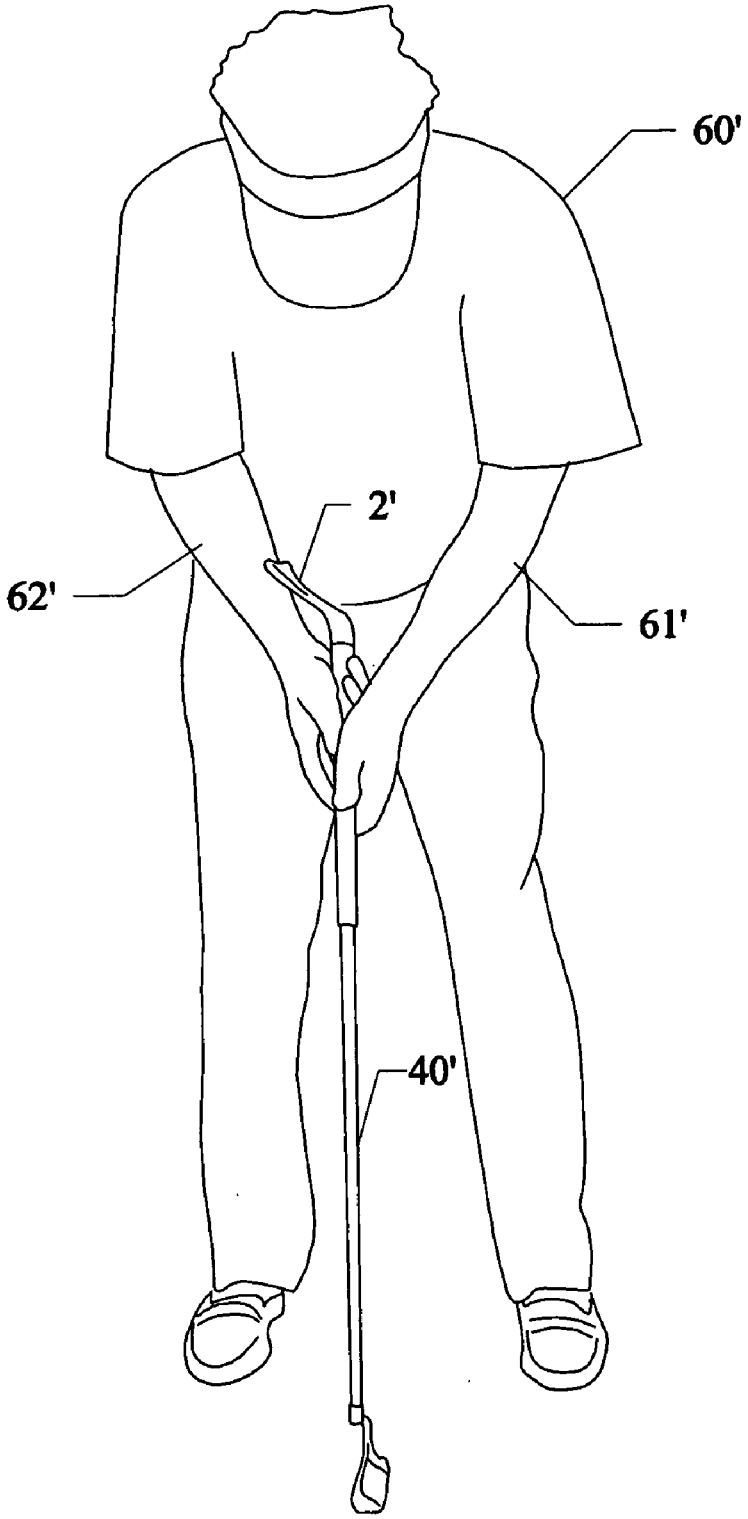
FIG. 22 is a perspective view of a left-handed golfer holding the golf club putter of FIG. 13B in the center of the golf stroke.
Figure 23:
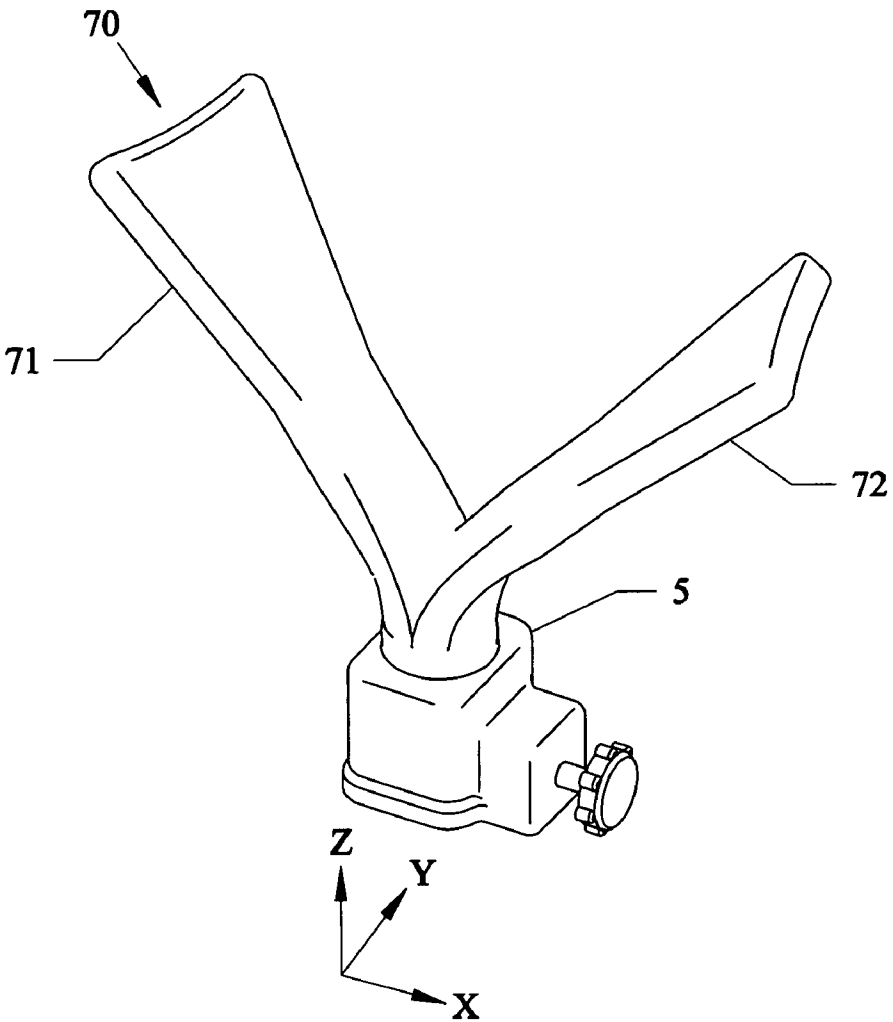
FIG. 23 is a front perspective view of the third embodiment of the golf training device with dual forearm plates.
Figure 26:
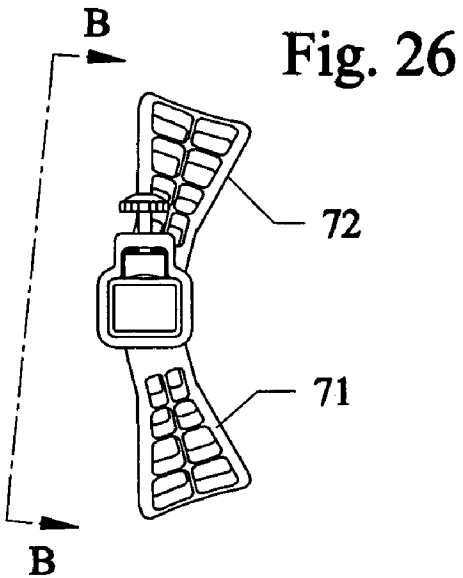
FIG. 26 is a bottom view of the golf training device of FIG. 24 rotated 180 degrees about the x-axis.
Figure 25:
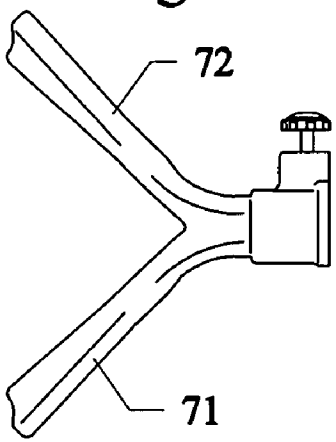
FIG. 25 is a side view of the golf training device of FIG. 24 rotated 90 degrees about the x-axis.
Figure 24:
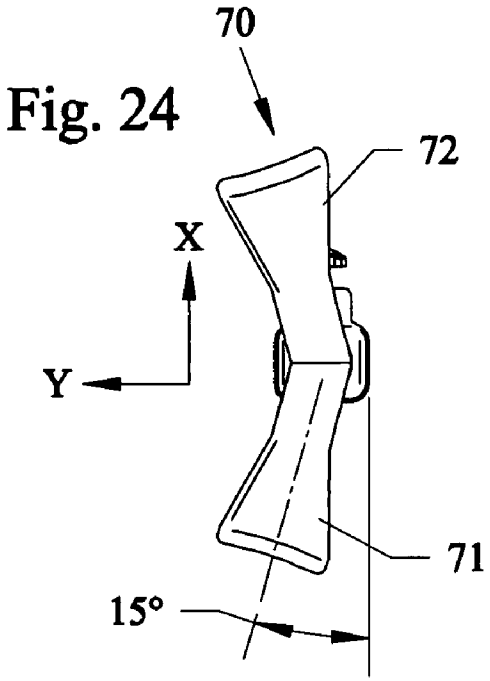
FIG. 24 is a top view of the golf training device of FIG. 23.
Figure 27:
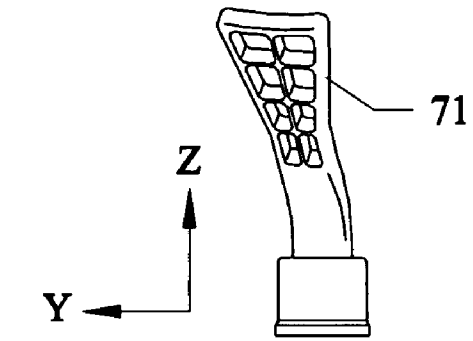
FIG. 27 is a side view of the golf training device of FIG. 24 rotated 90 degrees about the y-axis.
Figure 28:
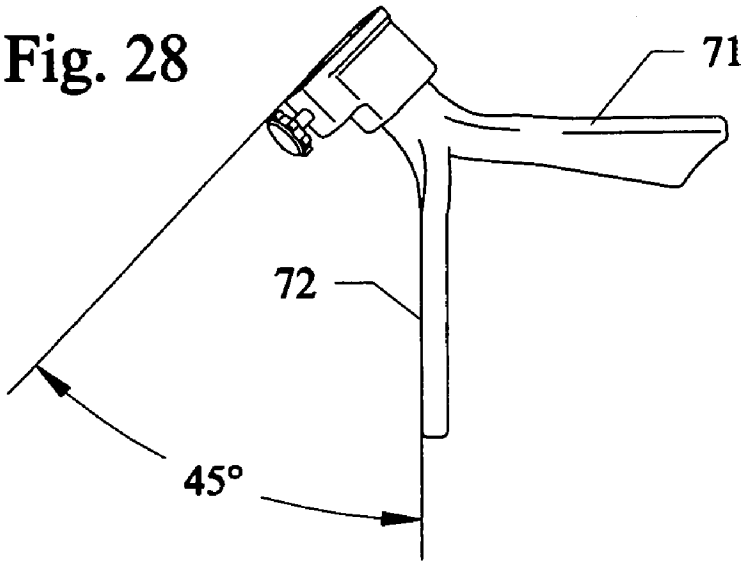
FIG. 28 is a view of the third embodiment of the golf training device taken along line B—B of FIG. 26.
Figure 29:
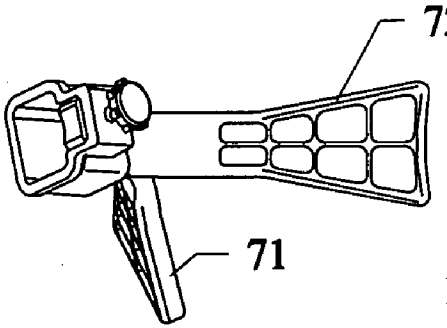
FIG. 29 is a view of the golf training device of FIG. 28 rotated 90 degrees about a line that is perpendicular to the longitudinal axis of the right forearm plate and perpendicular to the plane of the right forearm plate and rotated 90 degrees about a line that is perpendicular to the longitudinal axis of the right forearm plate and parallel to the plane of the right forearm plate.

FIG. 22 is a perspective view of the left-handed golfer 60' holding the golf club putter 40' of FIG. 13B in the center of the golf stroke. The forearm plate 2 of the golf club putter 40' is positioned against the right arm 62' of golfer 60'. FIG. 23 is a front perspective view of the third embodiment of the golf training device 70 including left forearm plate 71 and right forearm plate 72 attached to attachment socket 5. FIG. 24 is a top view of the golf training device 70 of FIG. 23. FIG. 25 is a side view of the golf training device 70 of FIG. 24 rotated 90 degrees about the x-axis. FIG. 26 is a bottom view of the golf training device 70 of FIG. 24 rotated 180 degrees about the x-axis. FIG. 27 is a side view of the golf training device 70 of FIG. 24 rotated 90 degrees about the y-axis. FIG. 28 is a view of the third embodiment of the golf training device 70 taken along line B—B of FIG. 26. FIG. 29 is a view of the golf training device 70 of FIG. 28 rotated 90 degrees about a line that is perpendicular to the longitudinal axis of the right forearm plate 72 and perpendicular to the plane of the right forearm plate 72 and rotated 90 degrees about a line that is perpendicular to the longitudinal axis of the right forearm plate 72 and parallel to the plane of the right forearm plate 72.

Figure 30:
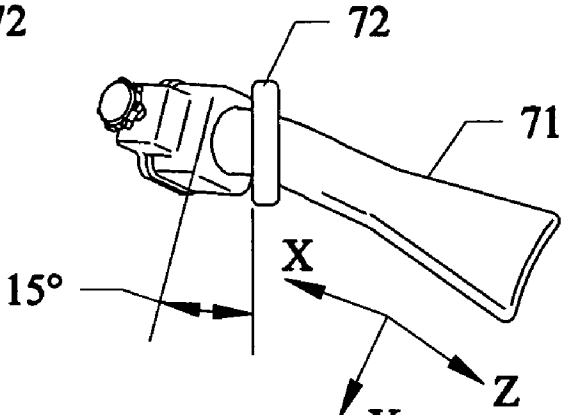
FIG. 30 is a view of the golf training device of FIG. 28 rotated 90 degrees about a line that is perpendicular to the longitudinal axis of the right forearm plate and perpendicular to the plane of the right forearm plate.
Figure 31:
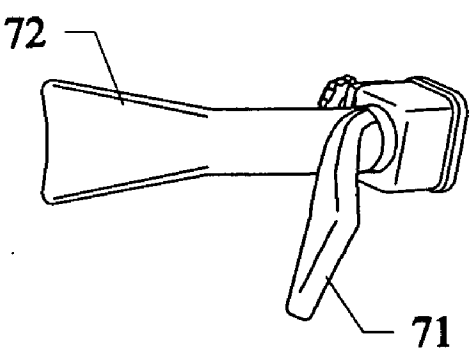
FIG. 31 is a view of the golf training device of FIG. 30 rotated 90 degrees about a line that is perpendicular to the longitudinal axis of the right forearm plate and parallel to the plane of the right forearm plate.

FIG. 30 is a view of the golf training device 70 of FIG. 28 rotated 90 degrees about a line that is perpendicular to the longitudinal axis of the right forearm plate 72 and perpendicular to the plane of the right forearm plate 72. FIG. 31 is a view of the golf training device 70 of FIG. 30 rotated 90 degrees about a line that is perpendicular to the longitudinal axis of the right forearm plate 72 and parallel to the plane of the right forearm plate 72.

Referring to FIGS. 24–27, the longitudinal axis of the right forearm plate 72 is bent at approximately a 15 degree angle to the x axis of golf training device 70 in a direction away from the body of the golfer when the golf training device 70 is attached to the golf grip 21 of the golf club 20. The longitudinal axis of the left forearm plate 71 is bent at approximately a 15 degree angle to the x-axis in the opposite direction of the right forearm plate 72 and in a direction away from the body of the golfer when the golf training device 70 is attached to the golf grip 21 of the golf club 20.

Referring to FIG. 30, the surface of the right forearm plate 72 is slanted at approximately a 15 degree angle to the y-axis of the golf trainer device 70. The surface of the left forearm plate 71 is slanted at approximately a 15 degree angle to the y-axis of the golf trainer device 70 in the opposite direction of the right forearm plate 72.

Figure 32:
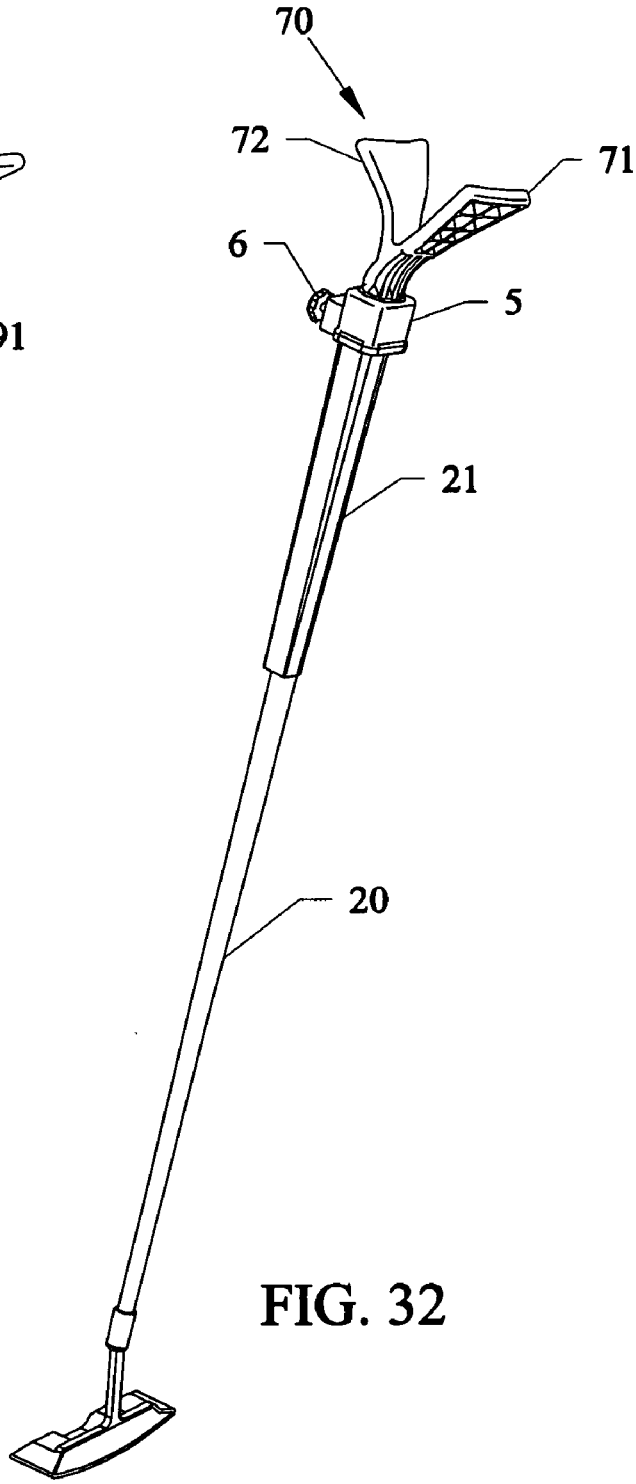
FIG. 32 is a perspective view of the third embodiment of the golf training device with dual forearm plates as a removable attachment that is mounted to the grip of a golf club putter.

FIG. 32 shows the golf training device 70 attached to golf club grip 21 of golf club putter 20 for use by a left-handed or right-handed golfer. The golf training device 70 is secured to the golf club grip 21 of the golf club putter 20 by turning the adjustment screw knob 6 of attachment socket 5.

Figure 33:
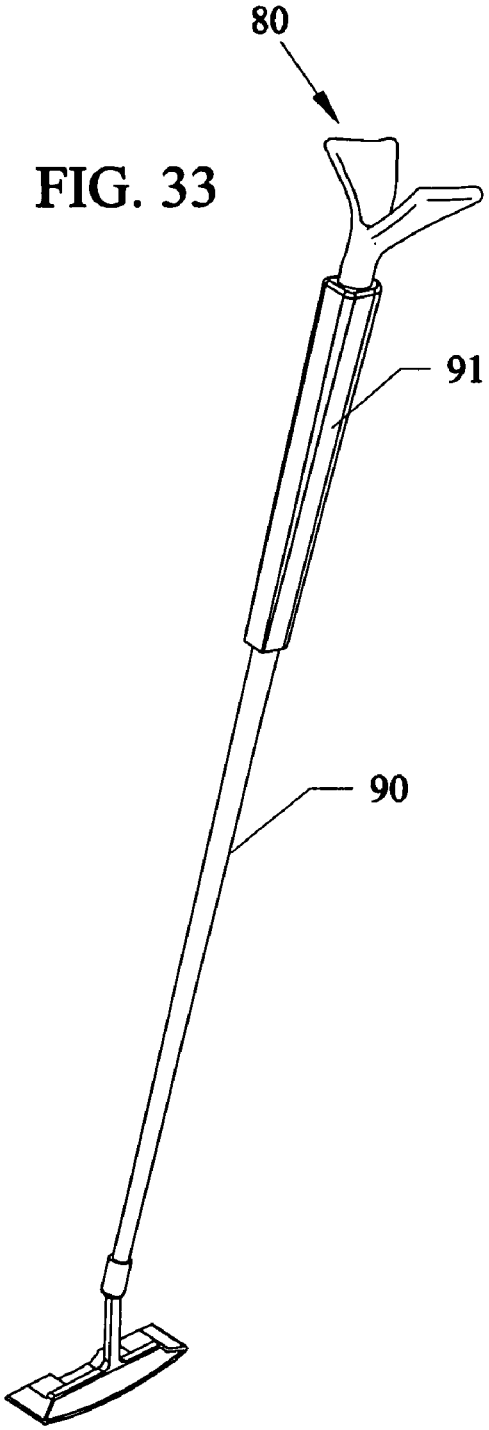
FIG. 33 is a perspective view of a fourth embodiment of the golf training device with dual forearm plates fabricated as an integral part of the golf club grip of a golf club putter.

FIG. 33 shows a fourth embodiment of the golf training device 80 fabricated as an integral part of the golf club grip 91 of the golf club putter 90.

Figure 34:
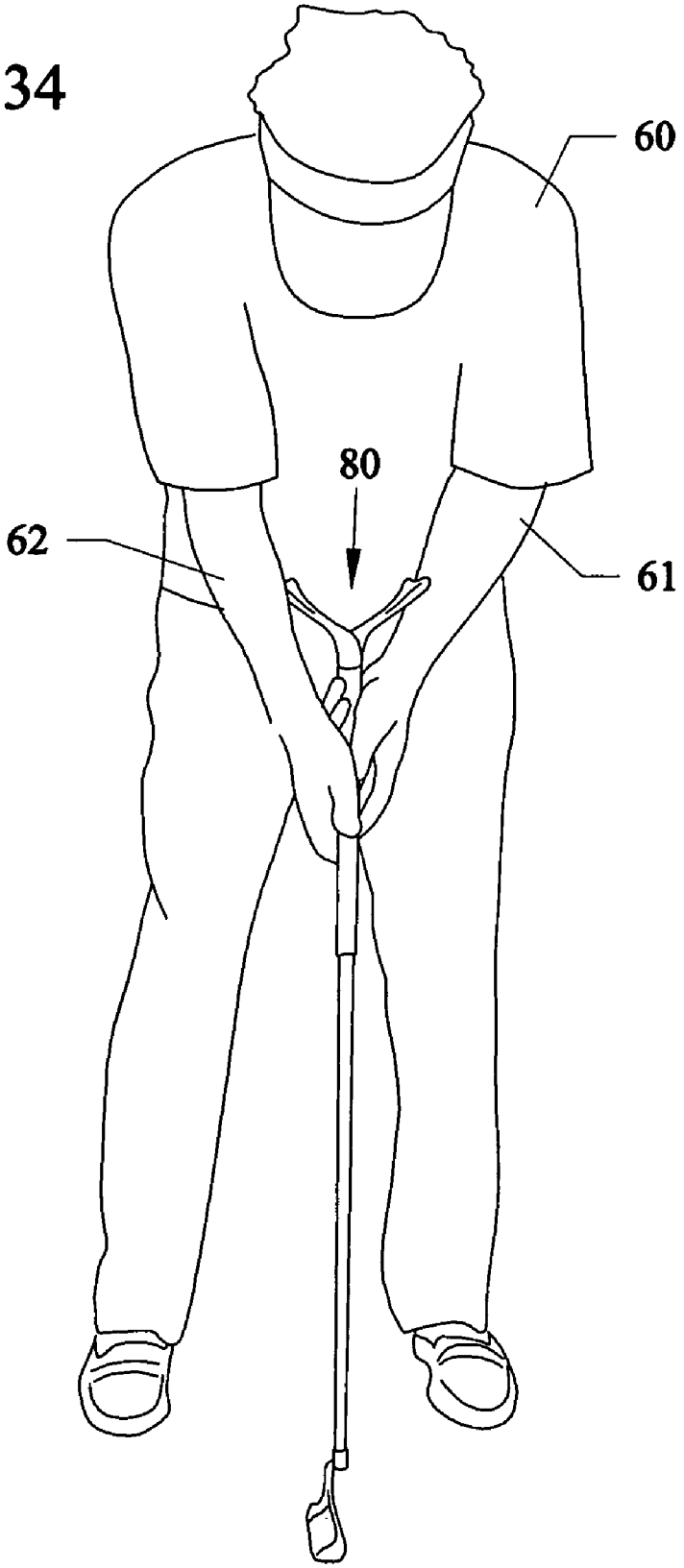
FIG. 34 is a perspective view of a golfer holding the golf club putter of FIG. 33.

FIG. 34 is a perspective view of the golfer 60 holding the golf club putter 90 with integral golf training device 80 of FIG. 33. The use of the golf training device 80 of the present invention results in the arms 61 and 62 of the golfer being placed in a desired triangular formation so that it is the large muscles of the upper arms and shoulders which participate in the stroke, rather than the smaller muscles of the wrists and lower forearms.

The novel attachment device can be formed from metal such as but not limited to stainless steel, aluminum, and the like, into a single piece with a separate screw knob.

Alternatively, the novel invention as an attachment device can be preferably molded from and into a single piece of plastic, where only the screw knob and an internal piece are separately added.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A golf training device attached to an upper end of a handgrip portion of a shaft on a golf club for aiding in putting and chipping shots, the device comprising:

an attachment socket for attaching the device to a top upper end of the hand grip portion above the shaft of the golf club, the shaft and the hand grip portion having a longitudinal axis, the attachment socket fits as a cap over the top upper end; and a single planar plate having a substantially flat upper surface and a substantially flat lower surface, the single planar plate extending above the attachment socket, the single planar plate having a narrow proximal end and wider distal end, the narrow proximal end being connected to the attachment socket, the narrow proximal end being fixably bent at a first angle and fixably twisted at a second angle relative to the longitudinal axis of the hand grip and the golf club shaft so that the wider distal end of the single planar plate rests against one lower inner forward forearm of a golfer, the device not having other portions for contacting against other body portions of the golfer, the first angle being different from the second angle.

2. The golf training device of claim 1 wherein the device is removably affixable to the golf club by the attachment socket by rotating an exterior end of an adjustment screw so that the screw threads through a side hole in the attachment socket so that a clamp plate on an inner end of the adjustment screw abuts and tightens against a side of the hand grip portion of the golf club to secure the golf training device to the hand grip portion of the golf club.

3. The golf training device of claim 2, wherein the attachment socket and the single plate include one of: a single piece of metal, and a single piece of plastic.

4. The golf club training device of claim 1 wherein the plate is slightly concave-shaped at its distal end at a point of contact with the lower inner forward forearm of the golfer.

5. The golf club training device of claim 2 wherein the plate is slightly concave-shaped at its distal end at a point of contact with the lower inner forward forearm of the golfer.

6. The golf club training device of claim 4 wherein the attachment socket is removably attached to the hand grip portion of the golf club by rotating an exterior end of an adjustment screw so that the screw threads through a side hole in the attachment socket so that a clamp plate on an inner end of the adjustment screw abuts and tightens against a side of the hand grip portion of the golf club to secure the golf training device to the hand grip portion of the golf club.

7. The golf club training device of claim 1 wherein the first angle is approximately 45 degrees, and the second angle is approximately 15 degrees.

8. The golf club training device of claim 2 wherein the first angle is approximately 45 degrees and the second angle is approximately 15 degrees.

9. The golf club training device of claim 6 wherein the first angle is approximately 45 degrees and the second angle is approximately 15 degrees.

10. A combined golf training device and golf club for aiding in putting and chipping shots, the combined device and golf club comprising:

a golf club having a shaft with a longitudinal axis and a hand rip portion on an upper end of the shaft, the hand grip portion having a top end;

a single planar plate having a substantially flat upper surface and a substantially flat lower surface, the single planar plate having a narrow proximal end permanently attached to the hand grip portion of the golf club, and a wider distal end, the single planar plate extending above the hand grip portion, the narrow proximal end being bent and twisted at two different angles, so that the wider distal end of the single planar plate rests against a lower inner forward forearm of a golfer, the device not having other portions for contacting against other body portions of the golfer.

11. The combined golf club training device and golf club of claim 10 wherein the single planar plate is slightly concave-shaped at at points of contact with the lower inner forward forearms of the golfer.

12. The combined golf club training device and golf club of claim 10, wherein the narrow proximal end is bent at an angle of approximately 45 degrees and twisted at an angle of approximately 15 degrees.

13. A combined golf training device and golf club for aiding in putting and chipping shots, the device for alternatively training right handed and left handed players with the same combined golf training device and golf club, the golf club having a shaft and a hand grip portion, the hand grip portion and the shaft having a longitudinal axis, the combined device and golf club comprising:

a first single planar plate having a substantially flat upper surface and a substantially flat lower surface, the first single planar plate having a first narrow proximal end that is attached to and extending upward from a top end of the hand grip portion of the golf club, and a wider distal end having a concave edge, the first single planar plate extending above the first narrow proximal end, the first narrow proximal end being bent at a first angle relative to the longitudinal axis of the golf club and also twisted at a second angle so that the concave edge of the wider distal end of the first single planar plate rests against a right lower inner forward forearm of a golfer;

a second single planar plate having a substantially flat upper surface and a substantially flat lower surface, the second single planar plate second narrow proximal end that is attached to and extending upward from a top end of the hand grip portion of the golf club, and a wider distal end having a concave edge, the second single planar plate extending above the second narrow proximal end, the second narrow proximal end being bent at a third angle relative to the longitudinal axis of the golf club and also twisted at a fourth angle so that the concave edge of the wider distal end of the second single planar plate rests against a left lower inner forward forearm of the golfer, wherein the device is used for alternatively training right handed and left handed golfers, so that using the first single planar plate solely contacts the right forearm of a right handed golfer while no other portion of the device contacts another forearm of the golfer, and so that using the second single planar plate solely contacts the left forearm of the left handed golfer while no other portion of the device contacts other body portions of the golfer.

14. The combined golf training device and golf club of claim 13, wherein the first angle and the third angle are each approximately 45 degrees, and the second angle and the fourth angle are each approximately 15 degrees.

* * * * *